US010006181B2

(12) United States Patent
Xu

(10) Patent No.: US 10,006,181 B2
(45) Date of Patent: Jun. 26, 2018

(54) SHOVEL FLIP STRUCTURE OF SNOWPLOW

(71) Applicant: Taiwan Hiroichi Company Ltd., Nantou, Nantou Hsien (TW)

(72) Inventor: Wen-Yi Xu, Nantou Hsien (TW)

(73) Assignee: Taiwan Hiroichi Company Ltd., Nantou, Nantou Hsien (TW)

( * ) Notice: Subject to any disclaimer, the term of this patent is extended or adjusted under 35 U.S.C. 154(b) by 224 days.

(21) Appl. No.: 14/672,650

(22) Filed: Mar. 30, 2015

(65) Prior Publication Data

US 2015/0275448 A1 Oct. 1, 2015

(30) Foreign Application Priority Data

Mar. 31, 2014 (TW) ..... 103205487 U
Apr. 8, 2014 (CN) ..... 2014 2 0167479 U

(51) Int. Cl.
*E01H 5/06* (2006.01)

(52) U.S. Cl.
CPC ..... *E01H 5/06* (2013.01)

(58) Field of Classification Search
CPC .. E01H 5/02; E01H 5/06; E01H 5/061; E01H 5/063; B62B 1/147; B62B 1/16; B62B 1/24; B62B 2203/05; E02F 3/3417; E02F 3/3405
See application file for complete search history.

(56) References Cited

U.S. PATENT DOCUMENTS 861,274 A * 7/1907 Ensrud et al. ..... A01D 9/00 254/131.5
887,874 A * 5/1908 Toy ..... B62B 1/147 37/434
1,672,490 A * 6/1928 Herchert ..... E01H 5/02 37/274
2,037,222 A * 4/1936 Farrar ..... B62B 1/24 280/47.31
2,538,000 A * 1/1951 Hoar ..... E02F 3/3405 414/696
2,738,223 A * 3/1956 Metailler ..... B60P 1/06 298/17.5
2,764,307 A * 9/1956 Kughler ..... E02F 3/3417 414/607
3,021,625 A * 2/1962 Stasse ..... B62B 1/24 180/19.1
3,028,695 A * 4/1962 Westby ..... B62B 1/147 280/47.29
3,845,577 A * 11/1974 Naymik ..... E01H 5/063 172/273
4,302,894 A * 12/1981 Emma ..... B62B 1/147 298/2

(Continued)

*Primary Examiner* — Jamie L McGowan
(74) *Attorney, Agent, or Firm* — Boyle Fredrickson, S.C.

(57) ABSTRACT

A snowplow shovel has a handle bar for pushing and controlling the snowplow that is constructed as a linking structure. A guide plate is disposed on a frame on a rear side of the shovel in advance, such that a pin can be directly inserted and slide in a guide groove of the guide plate. After snow shoveling is performed through pushing and control the handle bar, the shovel can simultaneously move to a snow collection location and move upwardly in corporation with pressing the handle bar. The shovel can achieve the operation of automatic snow unloading via naturally swinging and flipping along the direction of the arc of the guide groove according to the guidance of the pin inserted in the guide groove.

2 Claims, 5 Drawing Sheets

(56) References Cited

U.S. PATENT DOCUMENTS 5,018,282 A * 5/1991 Hong ..... B62B 1/147 37/265
5,048,206 A * 9/1991 Jones ..... B62B 1/147 280/651
5,669,163 A * 9/1997 Winter ..... E01H 5/02 37/265
6,735,887 B1 * 5/2004 Muzzammel ..... E01H 5/02 37/285
7,681,336 B2 * 3/2010 Noonan ..... B62B 1/147 294/54.5
7,681,932 B2 * 3/2010 Chang ..... E01H 5/02 294/54.5
7,937,859 B2 * 5/2011 Downes ..... B62B 1/147 294/176
8,240,069 B2 * 8/2012 Adinata ..... A61K 48/00 37/285
8,668,210 B2 * 3/2014 Stevens ..... B62B 1/06 280/47.26
9,238,894 B1 * 1/2016 Campos ..... E01H 5/02
9,366,003 B1 * 6/2016 Stenzel ..... E02F 3/02
2005/0160632 A1 * 7/2005 Williams ..... E01H 5/02 37/265
2006/0214443 A1 * 9/2006 Dixon ..... E01H 5/02 294/54.5
2006/0283611 A1 * 12/2006 Wittkowski ..... E02F 3/02 172/817
2007/0227048 A1 * 10/2007 Adinata ..... E01H 5/02 37/285
2013/0189067 A1 * 7/2013 Notohardjono ..... B65D 19/40 414/800

* cited by examiner

SHOVEL FLIP STRUCTURE OF SNOWPLOW

BACKGROUND OF THE INVENTION

1. Field of the Invention

The present invention relates to a shovel flip structure of a snowplow wherein a guide plate is disposed on a frame of the snowplow in advance, such that a pin connected to the shovel can be inserted in a guide groove. The shovel can achieve the purpose of simple and automatic operation of flipping and unloading through moving upwardly along an arc of the guide groove according to controlling and moving a handle bar after snow shoveling.

2. Description of the Related Art

In general, when clearing accumulated snow during heavy snowing, since the accumulated snow is too thick, it usually needs to use machines to shovel snow for effectively and quickly clean. The traditional snow shoveling equipment, except for the domestic manual shoveling operation, performs by relying on auxiliary machines over a wide range of lots of accumulated snow outdoors. Otherwise, it would be difficult to clean effectively. The design of the mobile large snow shoveling equipment is not discussed and described in this invention. In general, the shovel for snow shoveling and unloading of the small snow shoveling equipment is mostly designed to have a fixed angle in structure. During the process of transferring after snow shoveling, the frame is usually pushed in a certain inclination angle. Otherwise, the shoveled snow easily falls out resulting in a situation of being laborious and difficult to be pushes. In addition, due to the design of fixed shovel, during unloading after snow shoveling, it needs the help of suitable auxiliary inclined plate surface to facilitate the control of convenient unloading. It results in the situation of inconvenient control and the further hazardous situation of laborious push and control and having difficult to be fixed dining unloading due to the inclination rate of the plate surface. Therefore, the existing shovel structure is improved to have the effect of automatically flipping and unloading operations in order to achieve rapid and effective snow shoveling and the utility requirement of effort saving. Hence, the snowplow of this invention is developed.

SUMMARY OF THE INVENTION

In view of the utility defect of the design of snow shoveling and unloading of the present snowplow, the inventor work hard to perform experiments and researches and finally develops an improvement of a shovel flip structure of a snowplow of this invention. A handle bar for operation and control of the snowplow is connected to a shovel via a frame bar. A guide plate disposed in advance and the shovel are inserted to each other via a pin. The shovel is to perform simple operation and control of flipping and unloading according to an arc of a guide groove. Therefore, the various utility defect of operation and control of the present snowplow during snow transferring and unloading are inched improved.

The primary objective of this invention is in that the shovel is connected together with the handle bar for operation and control of the snowplow via the frame bar and mounted to the arc guide groove of the guide plate disposed on a front side of the frame in advance, such that a pin connected to the shovel is inserted in the guide groove of the guide plate. Therefore, the shovel can adequately move after shoveling snow through controlling the handle bar and can achieve the performance of automatically flip and unload along the Marc guide groove during movement. The whole snow shoveling device can achieve the utility purpose of safe collecting, effort-saving for automatic flip and unloading.

DESCRIPTION OF THE PREFERRED EMBODIMENTS

Figure 1:
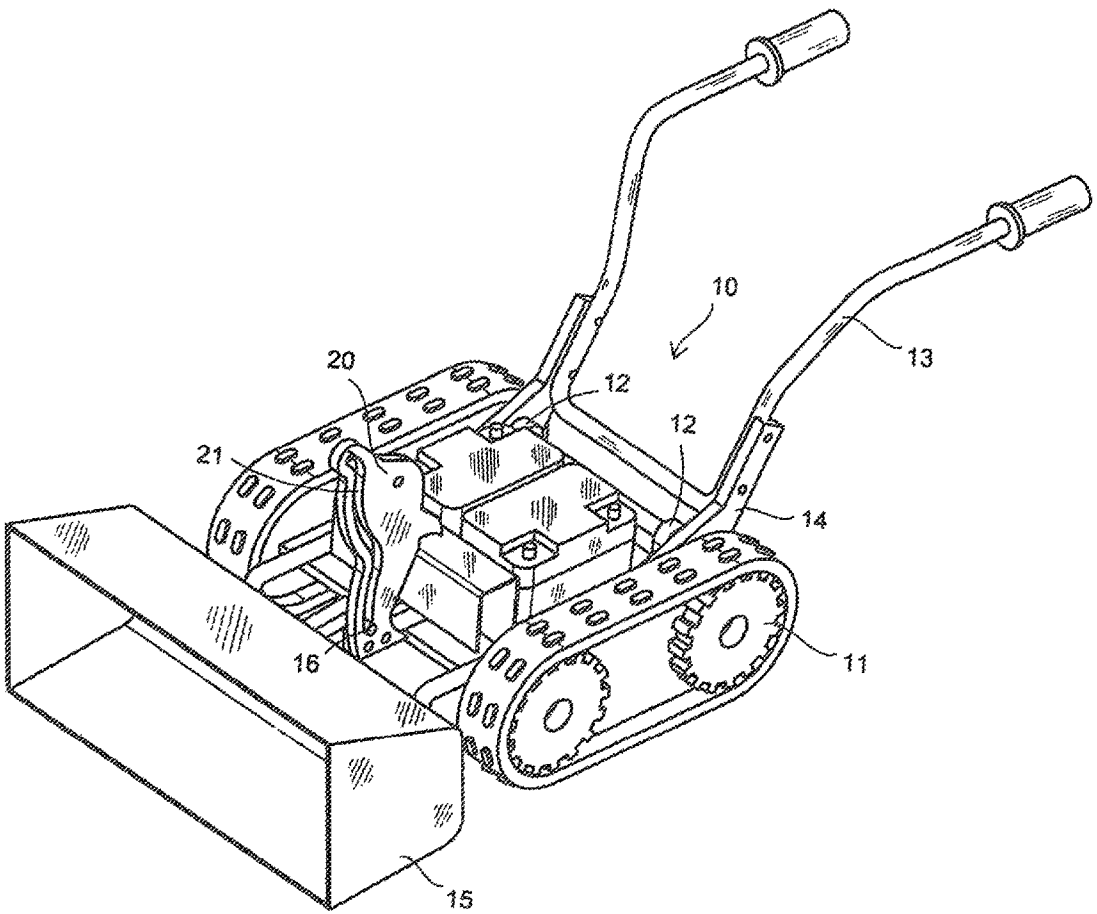
FIG. 1 illustrates a schematic diagram of a snowplow of this invention.
Figure 2:
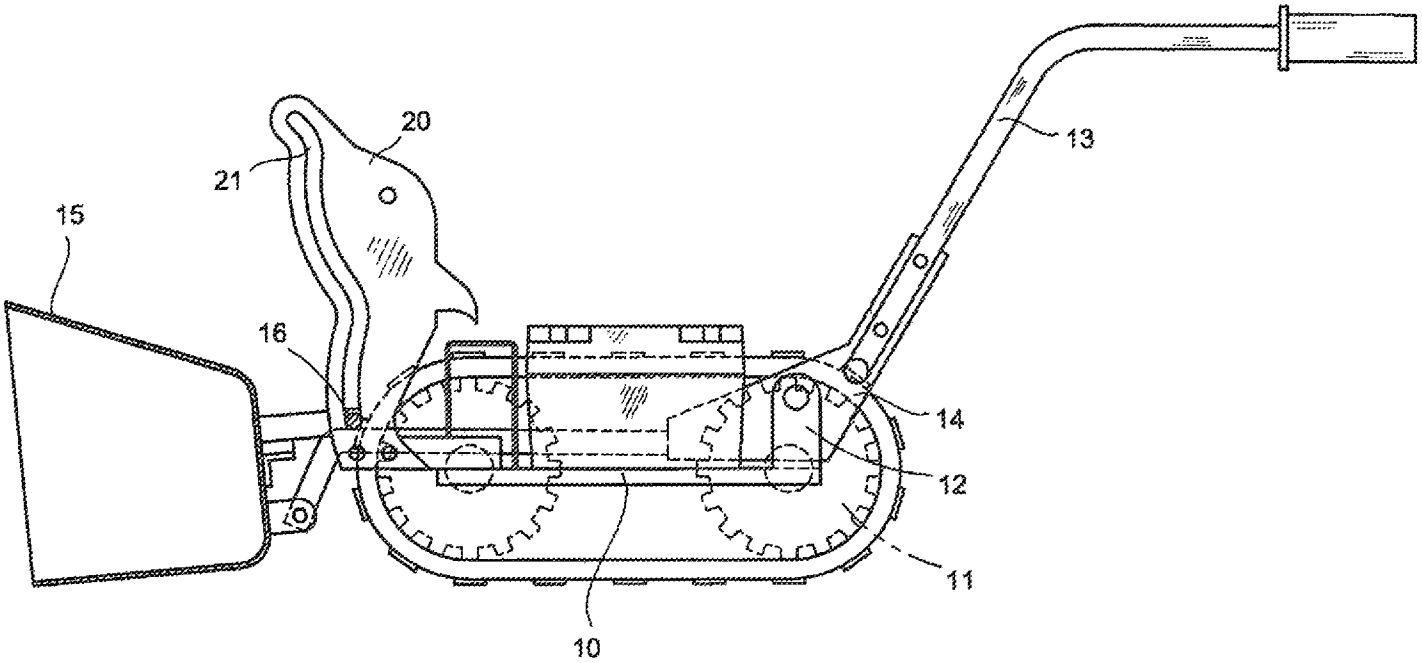
FIG. 2 illustrates a side view of the snowplow of this invention.

In order to further understand the improvement of the feature of the structure and the accompanying practical purposes of this invention, the detailed description is as follows with the drawings.

In an improvement of a shovel flip structure of a snowplow of this invention, the improvement of the structure is primarily to provide simple control for the operation of now shoveling and unloading of the whole shovel for snow shoveling such that convenient and safe use of snow shoveling can be achieved. Referring to FIGS. 1 to 5, the improvement of the structure includes a frame 10 for assembly. A conveyor wheel assembly 11 is assembled to opposite sides thereof for flip controlling. The frame 10 has opposite fixing shaft bases 12 adjacent to a controlling side provided for the pivotal mount of a handle bar 13 for manipulating drive which is integrally connected to a shovel 15 with a specific conical shovel shape via a frame bar 14. The whole shovel 15 can move between a higher position and a lower position through the control of the handle bar 13. A guide plate 20 is disposed to an adequate central location of a shovel 15 mounting side of the frame 10 and provided with a guide groove 21 with a specific arc on a center thereof. A linking pin 16 mounted on an upper edge of a back of the shovel 15 is inserted into the guide groove 21. The shovel 15 changing positions through sliding along the arc of the guide groove 21 via the pin 16 when moving upwardly or downwardly by the handle bar 13. The appearance of the guide plate can be designed according to the requirement of ornamentation for different shapes of the plate. For example, the fish-shaped appearance as illustrated in the drawings can increase the value of ornamentation of the snowplow. Therefore, the operation of unloading via tilting downwardly by moving a snow shoveling edge of the shovel 15 to an upper edge of the guide plate 20 can be achieved. The operation of snow shoveling is convenient and transferring during movement is safe without falling out based on achievement of the adequate change of position of the shovel 15. The purpose of practical efficacy can be achieved through more simple and convenient, control of snow shoveling and cleaning and more quick and simple work of snow shoveling while complying with safe control.

Figure 3:
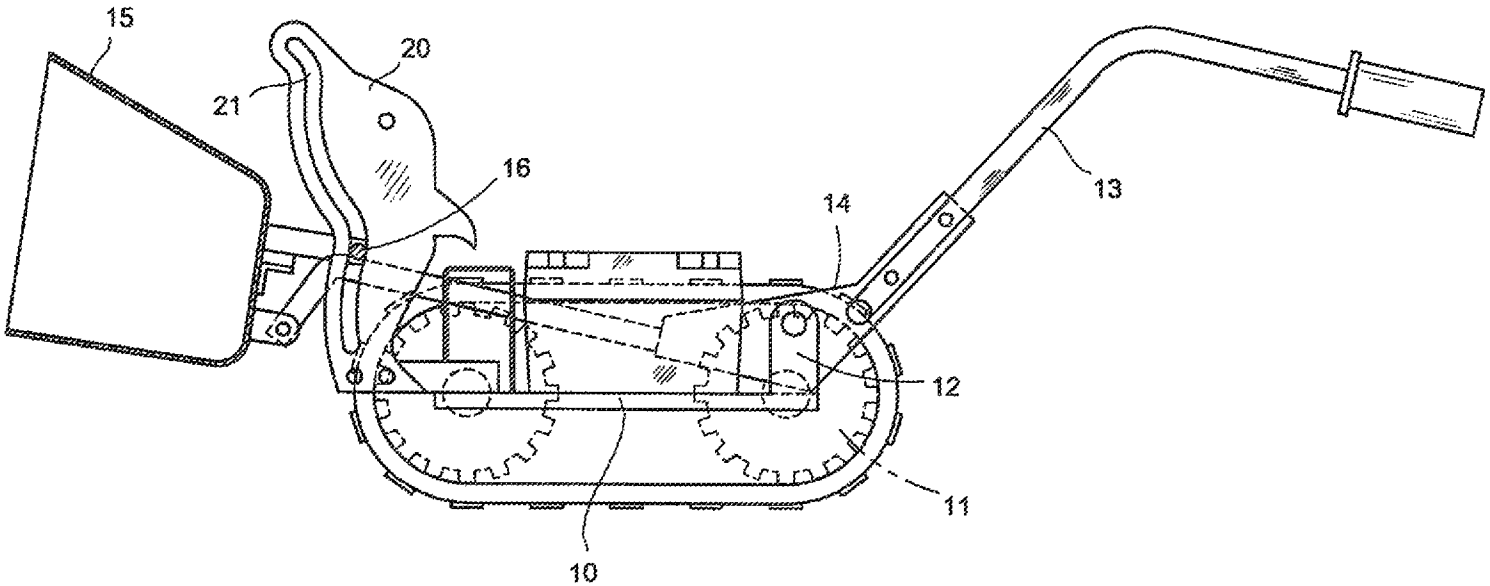
FIG. 3 illustrates a schematic diagram of the snowplow of this invention in which a shovel has shoveled snow.
Figure 4:
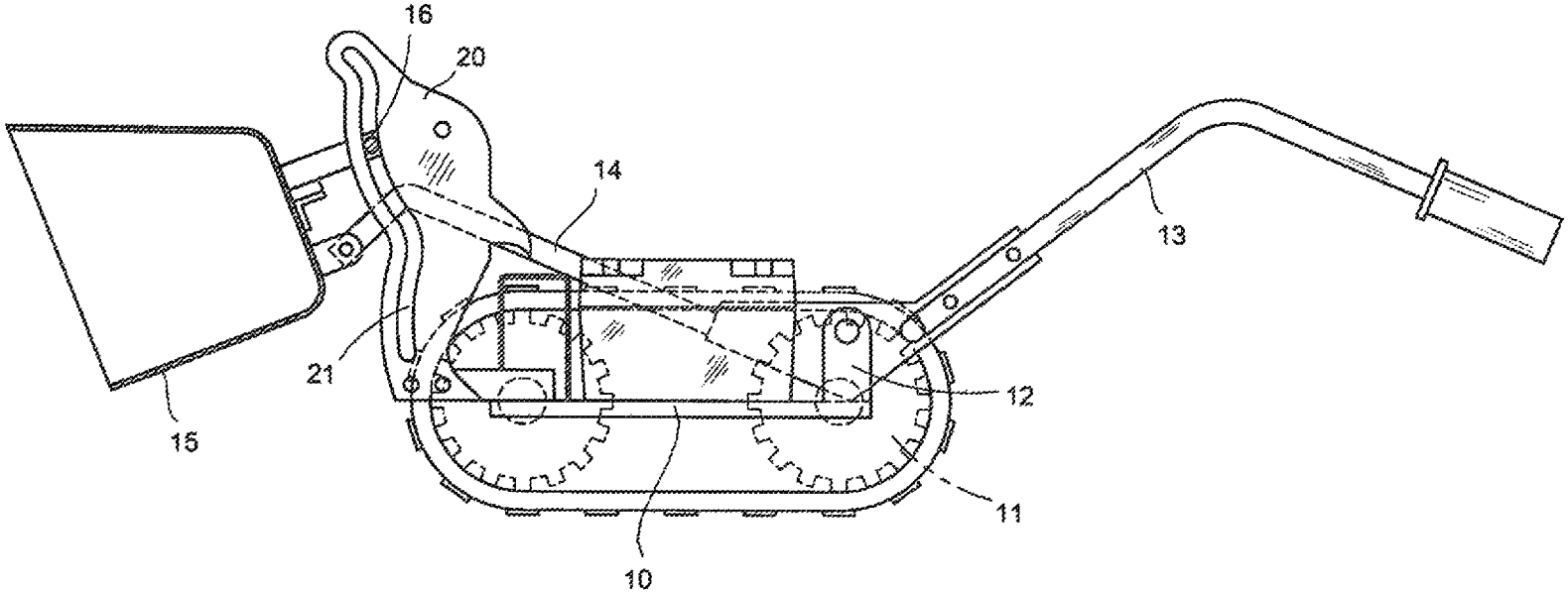
FIG. 4 illustrates a schematic diagram of the snowplow of this invention in which the shovel is unloading.
Figure 5:
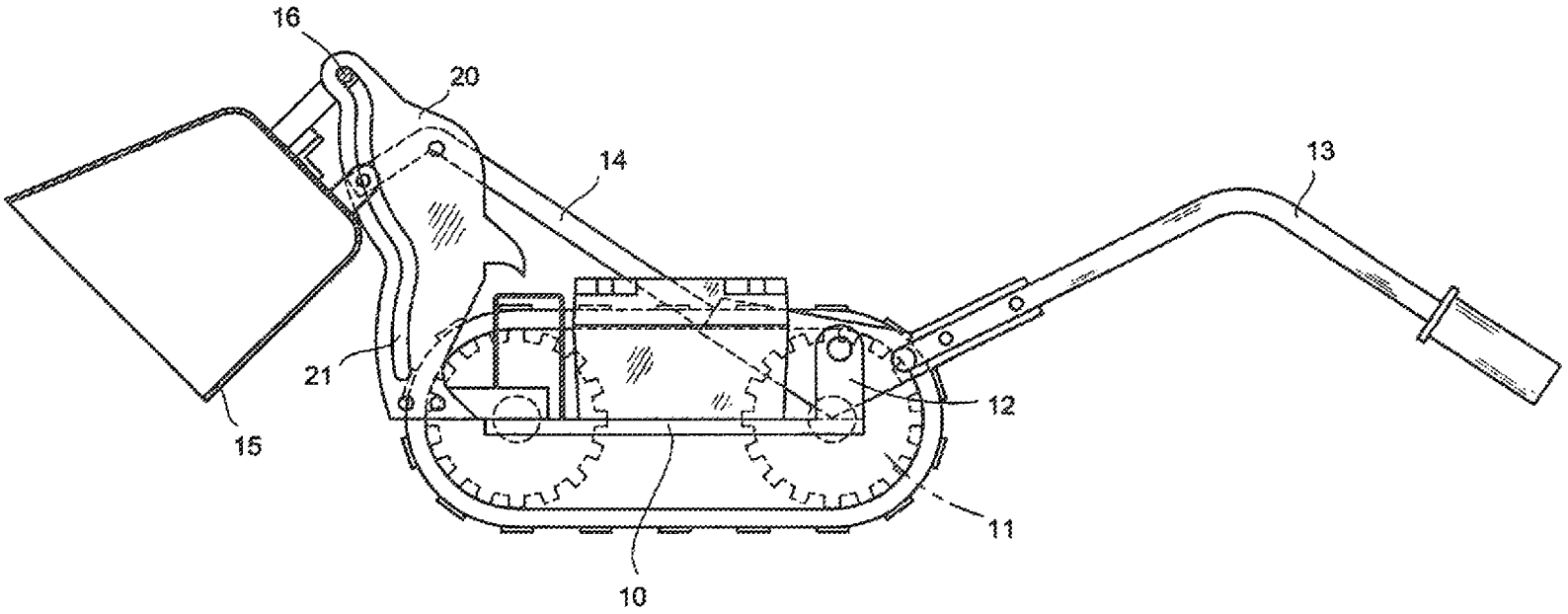
FIG. 5 illustrates a schematic diagram of the snowplow of this invention in which the shovel has unloaded.

The improvement of the operation and control of the shovel 15 for snow shoveling of this invention is characterized in that the angle of the position of the shovel 15 for snow shoveling can be simply operated is the handle bar 13 based on the connection with the handle bar 13. In addition, as illustrated in FIG. 3, the snow shoveling edge of the shovel 15 can be effectively controlled to swing as a horn shape slightly raised for preventing from snow dropping after snow shoveling by pressing the handle bar 13 with different angles in corporation with the design of the location change of the mutual insertion of the guide groove 21 of the guide plate 20 and the pin 16 in the arc. The arc shape of the groove can provide for positioning of the shovel. And other electric devices are used as auxiliary for drive control. However, the effort-saving auxiliary of this invention is not the major feature and thus will not be described in detail. The major improvement of the whole structure is in that the shovel 15 can reliably shovel snow through the connection of the guidance of guide groove 21 to the pin 16 and the direct control of the handle bar 13. Transferring during movement is more effort-saving without the security concern of the falling out of the shoveled snow. In addition, as illustrated in FIGS. 4 and 5, the shovel 15 can be pushed to a higher position at the location of snow collection and its snow shoveling edge can automatically tilt downwardly along the arc groove for the convenient of unloading thereby achieving continuous control without inconvenient unloading. Further, the design of automatic movement to the higher position for unloading is convenient for continuous accumulation during snow shoveling. The operation of snow shoveling for removing the accumulated snow can be performed continuously or intermittently so as to adequately transfer the accumulated snow. It can be independently and simply accomplished to effectively simplify the operation of snow shoveling and further to achieve the purpose of safe and effort-saving control. The structure design and control of the whole snowplow is the improvement in the structure of the product of the same type.

In conclusion, in the improvement of the shovel flip structure of the snowplow, the shovel and the handle bar are operatively linked together in corporation with control and guidance of the arc guide groove of the guide plate, such that the shovel can intermittently shovel and transfer snow and can automatically flip and unload. Therefore, the structure and operation of the snowplow is more convenient and safe and can achieve the feature of continuous control. The improvement of the structure and device can enhance performance and is applied for a patent based on the compliment with the Patent Act.

What is claimed is:

1. A snowplow comprising:

a frame, conveyor wheels arranged on opposite sides of the frame, a handle bar and a shovel for shoveling snow, wherein the shovel is fixed to the handle bar and the frame has a fixing shaft base for a pivotal mount of the handle bar, and further comprising a guide plate, the guide plate having a guide groove of a specific arc having a lower position, a center position, and a higher position, wherein a pin that is mounted on the back of the shovel is received in the guide groove and is configured to ride along the guide groove by movement of the handle bar such that 1) when the pin is moved by the handle bar to the lower portion of the guide groove, a snow shoveling edge of the shovel extends generally horizontally to facilitate snow shoveling, 2) when the pin is moved by the handle bar to the center position of the guide groove, the snow shoveling edge of the shovel is tilted upwardly to inhibit the snow shoveled from dropping, and 3) when the pin is moved by the handle bar to the higher position of the guide groove, the snow shoveling edge of the shovel is tilted downwardly to facilitate snow unloading.

2. The snowplow of claim 1, wherein the appearance of the guide plate can be ornamental.

* * * * *